United States Patent [19]

Fujita

[11] Patent Number: 4,939,187

[45] Date of Patent: Jul. 3, 1990

[54] PATTERN MATERIAL FOR MAKING FOUNDRY PATTERNS FOR USE IN INVESTMENT CASTING PROCESS

[76] Inventor: Tadao Fujita, 17-C-311, Yamatecho-3-chome, Suita-shi, Osaka-fu, Japan

[21] Appl. No.: 274,826

[22] Filed: Nov. 22, 1988

[30] Foreign Application Priority Data

Aug. 22, 1988 [JP] Japan ..... 63-209291

[51] Int. Cl.[5] ..... B22C 1/22

[52] U.S. Cl. ..... 523/139; 524/165; 524/211; 524/557; 524/238; 524/321; 524/482

[58] Field of Search ..... 523/139; 524/211, 165, 524/557

[56] References Cited

U.S. PATENT DOCUMENTS 3,250,748 5/1966 Suzumura ..... 525/61

FOREIGN PATENT DOCUMENTS 1458856 12/1976 United Kingdom .

*Primary Examiner*—Joseph L. Schofer
*Assistant Examiner*—John J. Guarriello
*Attorney, Agent, or Firm*—John F. A. Earley; John F. A. Earley, III; P. Michael Walker

[57] ABSTRACT

A pattern material for making foundry patterns for use in investment casting process, comprising urea, polyvinyl alcohol and a substance, said substance being capable of forming an eutectic mixture with polyvinyl alcohol to reduce the melting temperature of urea.

2 Claims, 1 Drawing Sheet

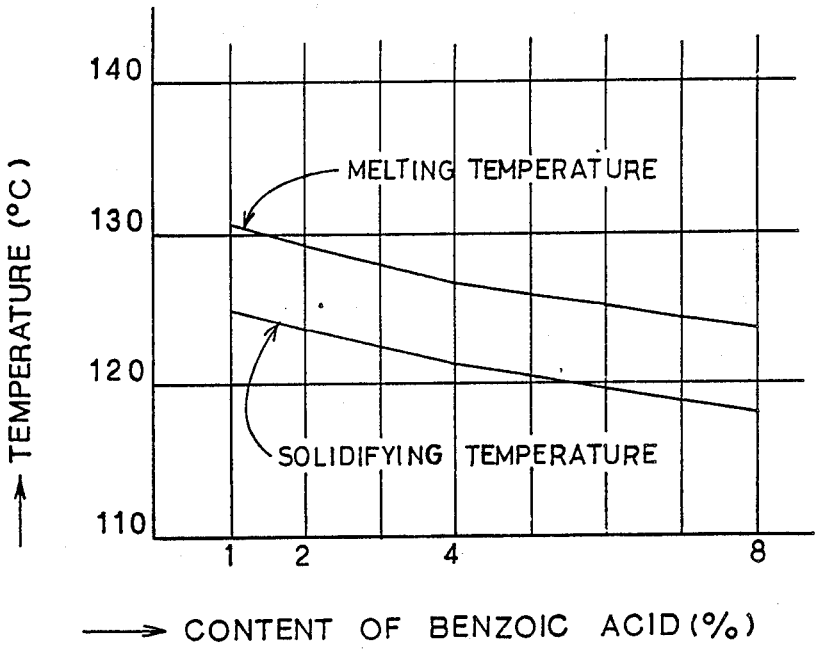
140
130
120
110
TEMPERATURE (°C)
MELTING TEMPERATURE
SOLIDIFYING TEMPERATURE
1
2
4
8
CONTENT OF BENZOIC ACID (%)

PATTERN MATERIAL FOR MAKING FOUNDRY PATTERNS FOR USE IN INVESTMENT CASTING PROCESS

TECHNICAL FIELD

This invention relates to pattern materials for making foundary patterns for use in investment casting process, and particularly to the pattern materials for making foundary patterns of close dimensional tolerance which are water-soluble, and which are to be destroyed by being dissolved out of the mould.

BACKGROUND OF THE INVENTION

Japanese Patent No. 941444 discloses a method for making water-soluble foundary patterns, wherein urea in powder for containing polyvinyl alcohol was melted to prepare a homogeneous mixture of urea and polyvinyl alcohol in the molten state, and the resultant molten mixture was formed into foundary patterns. In the method there were the following disadvantages: When the molten mixture was formed into patterns, the molten mixture has to be poured or injected into the patterns forming mould at temperatures below the melting temperature of urea. However, it required particular technique for the molten mixture to be formed into sound patterns, because a range of temperatures between the melting temperature and the solidifying temperature of the mixture was very narrow. Although a part of polyvinyl alcohol in the mixture was formed a solid solution with urea, the majority of polyvinyl alcohol was not melted. Thus, the molten mixture was mainly composed of urea, and had a narrow range of temperatures between the melting temperature and the solidifying temperature. As a result, the molten mixture was hardly formed into the patterns having a good surface quality. Furthermore, when urea had been melted before being added with polyvinyl alcohol, the molten urea was easily gasified, above the melting temperature (132.7° C.). It was possible to add moisture into the molten mixture so as to enlarge a range of temperatures between the melting temperature and the solidifying temperature, but in this case there was raised another problem of weakening the strength of the resultant patterns. Accordingly, it was necessary for the proportion of the moisture to be limited within a range between 0.5% and 2.0% by weight, and as a result, it was impossible to obtain a wide range of temperatures between the melting temperatures and the solidifying temperature, which range has been required in the injection moulding process.

SUMMARY OF THE INVENTION

An object of the present invention is to provide a pattern material in powder form, which has a lower solidifying temperature than that of the molten mixture of urea and polyvinyl alcohol according to the priot art, which has a wider range of temperatures than that of the molten mixture so as to be easily poured or injected in the mould, and which can be formed into foundary patterns having close dimensional tolerance, sufficient strength and good water-solubilty.

BRIEF DESCRIPTION OF THE DRAWINGS

FIGURE is a diagram showing a change of melting temperatures and a change of solidifying temperatures which examples of the pattern material according to the invention have.

DETAILED DESCRIPTION OF THE INVENTION

In accordance with the above-mentioned object, the invention provides a pattern material in powder form consisting of a mixture of urea, polyvinyl alcohol and a substance capable of forming an eutectic mixture with polyvinyl alcohol when urea is being melted, said eutectic mixture reducing the melting temperature of urea.

In the invention, as the substance capable of forming an eutectic mixture with polyvinyl alcohol when urea is being melted, said eutectic reducing the melting temperature and the solidifying temperature of urea, benzonic acid, benzene sulfinic acid, benzene sulfonic chloride or barium salt, sulfonic acid, benzoyl chloride, glycine, naphtalene, glutaric acid, etc. are used.

Preferably, the urea mixture is melted at temperatures between 120° C. and 132° C., and the molten mixture is poured or injected into the mould, after being cooled at a temperature between 105° C. and 120° C.

The melting temperature and the solidifying temperature are reduced in proportion to the quantity of the substance. When the substance is added less than 1% by weight, the substance is of no effect to prevent urea from being resolved into ammonia, and when the substance is added more than 10% by weight, physical properties of resultant patterns are damaged, with the result that it is difficult to form sound patterns. Accordingly, the substance is preferably added to the urea mixture in a range between 1% and 10% by weight, while polyvinyl alcohol is preferably added to the urea mixture in a range between 3% and 8% by weight.

EXAMPLES

A mixture of urea and polyvinyle alcohol, which contains 5% by weight of poylvinyl alcohol, was mixed with 1%, 2%, 3%, 4%, 5%, 6%, 7% or 8% by weight of benzoic acid to obtain 8 kinds of pattern materials according to the invention. Then, the melting temperatures and solidifying temperature of each pattern material were measured. As shown in an appended diagram, the melting temperature and solidifying temperature of each pattern material were reduced in proportion to the amount of benzonic acid, which had been added to the mixture of urea and polyvinyl alcohol, and there were almost constant differences of 6° C. between respective melting temperatures and respective solidifying temperatures. Then, patterns were formed by injecting each resultant mixture, which had been heated at a temperature between the melting temperature and the solidifying temperature, at a pressure of 10 kg/cm$^2$ into a conventional mould. When the patterns were soaked in water at a temperature of 10° C., the water-solubility of each pattern was 5.7 to 9.0 min/gr. The bending strength of each pattern was 30 to 90 kg/cm$^2$, with the result that it was confirmed that each pattern has a sufficient strength.

ADVANTAGES

As explained above, the pattern material according to the invention can be melted at temperatures below the melting temperature (123.7° C.) of urea, and the pattern material in the molten state has a low solidifying temperature and an enlarged range of temperatures between the melting temperature and the solidifying temperature. Accordingly, the pattern material can be poured or injected into the mould in the moulten state at a low pressure, so that the resultant patterns are produced at a low cost of tooling, and the strength and the water-solubility of the resultant patterns are never damaged. Furthermore, the pattern material can be formed into patterns, which have a good surface quality and close dimensional tolerance, and which are completely soluble in water, and the patterns enable at a low cost the production of precise moulds which are being required in the investment casting process.

I claim:

1. A pattern material for making foundary patterns for use in investment casting process, said pattern material comprising urea and polyvinyl alcohol and a substance capable of forming an eutectic mixture with polyvinyl alcohol when urea is being melted, said eutectic mixture reducing the melting temperature of urea, the substance being benzoic acid, benzene sulfinic acid, benzene sulfonic chloride or barium salt, sulfonic acid, benzoyl chloride, glycine, naphtalene, or glutaric acid.

2. A pattern material as claimed in claim 1, wherein the content of polyvinyl alcohol is 3 to 8% by weight, and the content of the substance is 1 to 10% by weight.

* * * * *